US009260270B2

(12) United States Patent
Ikeda et al.

(10) Patent No.: US 9,260,270 B2
(45) Date of Patent: Feb. 16, 2016

(54) PACKAGED CARBON FIBER PRECURSOR TOW, AND METHOD AND DEVICE FOR MANUFACTURING SAME

(75) Inventors: Katsuhiko Ikeda, Hiroshima (JP); Atsushi Kawamura, Hiroshima (JP); Hiromasa Inada, Hiroshima (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 80 days.

(21) Appl. No.: 13/389,723

(22) PCT Filed: Aug. 6, 2010

(86) PCT No.: PCT/JP2010/063408

§ 371 (c)(1), (2), (4) Date: Feb. 9, 2012

(87) PCT Pub. No.: WO2011/019002

PCT Pub. Date: Feb. 17, 2011

(65) Prior Publication Data

US 2012/0137638 A1 Jun. 7, 2012

(30) Foreign Application Priority Data

Aug. 11, 2009 (JP) ..... 2009-186418

(51) Int. Cl.

*B65B 1/04* (2006.01)
*D07B 1/22* (2006.01)
*B32B 1/06* (2006.01)

(Continued)

(52) U.S. Cl.

CPC ..... *B65H 55/04* (2013.01); *B65H 54/78* (2013.01); *B65H 55/00* (2013.01); *B65H 75/16* (2013.01);

(Continued)

(58) Field of Classification Search

CPC ..... B65H 54/78; B65H 55/00; B65H 55/005; B65H 55/02; B65H 5/04; B65H 75/16; B65H 75/182; D01F 6/18; D01F 9/14; B65D 83/00; B65D 71/00; G09F 2007/1839; G09F 2003/0208; G09F 2003/023; G09F 2003/0241; G09F 2003/0282

USPC ..... 206/83.5, 388, 225, 227, 392, 574; 53/429, 430; 493/413

See application file for complete search history.

(56) References Cited

U.S. PATENT DOCUMENTS 3,285,405 A * 11/1966 Wanderer ..... 206/499
3,779,705 A * 12/1973 Kitamura et al. ..... 8/613

(Continued)

FOREIGN PATENT DOCUMENTS

JP 47 51979 12/1972
JP 2002 138326 5/2002

(Continued)

OTHER PUBLICATIONS

International Search Report Issued Sep. 21, 2010 in PCT/JP10/63408 Filed Aug. 6, 2010.

*Primary Examiner* — Andrew Perreault
(74) *Attorney, Agent, or Firm* — Oblon, McClelland, Maier & Neustadt, L.L.P.

(57) ABSTRACT

The invention provides a packaged tow being characterized in that a carbon fiber precursor tow having a flattened shape in cross section and having a first surface and a second surface opposite to the first surface is layered and packaged in a packaging container in untwisted state. A front end and a back end of the carbon fiber precursor tow thus packaged are placed on a top of the fully-packaged carbon fiber precursor tow. When the front end and a back end of the tow are respectively applied with top/bottom surface identification means to identify top and bottom surfaces thereof, top and bottom surfaces on front ends and back ends of tows packaged in a plurality of packaging containers can be correctly identified and joined. As a result, thread breakage due to heat accumulation in twisted parts in a flame proofing process can be prevented from happening.

5 Claims, 9 Drawing Sheets

(51) Int. Cl.

| | |
|---|---|
| ***B65H 55/04*** | (2006.01) |
| ***B65H 54/78*** | (2006.01) |
| ***B65H 55/00*** | (2006.01) |
| ***B65H 75/16*** | (2006.01) |
| ***B65H 75/18*** | (2006.01) |
| ***D01F 6/18*** | (2006.01) |
| *D01F 9/14* | (2006.01) |

(52) U.S. Cl.
CPC ..... *B65H 75/182* (2013.01); *D01F 6/18* (2013.01); *B65H 2701/314* (2013.01); *D01F 9/14* (2013.01); *Y10T 428/13* (2015.01)

(56) References Cited

U.S. PATENT DOCUMENTS

| | | | | |
|---|---|---|---|---|
| 4,499,707 | A * | 2/1985 | Desjobert et al. | 53/429 |
| 4,641,687 | A * | 2/1987 | Kupcikevicius | 138/118.1 |
| 5,966,905 | A * | 10/1999 | O'Connor et al. | 53/429 |
| 6,138,440 | A * | 10/2000 | Gemma | 53/430 |
| 6,173,555 | B1 * | 1/2001 | Jaeger et al. | 53/429 |
| 2002/0069490 | A1 | 6/2002 | Service | |
| 2002/0119312 | A1 * | 8/2002 | Iwata et al. | 428/369 |
| 2009/0043254 | A1 * | 2/2009 | Pepper et al. | 604/103.07 |

FOREIGN PATENT DOCUMENTS

| | | |
|---|---|---|
| JP | 2004 76174 | 3/2004 |
| JP | 2006 176328 | 7/2006 |
| JP | 2007 169809 | 7/2007 |
| JP | 2008 121147 | 5/2008 |
| JP | 2008 150733 | 7/2008 |
| JP | 2009 12882 | 1/2009 |

* cited by examiner

PACKAGED CARBON FIBER PRECURSOR TOW, AND METHOD AND DEVICE FOR MANUFACTURING SAME

TECHNICAL FIELD

The invention relates to a packaged tow structurally characterized that a carbon fiber precursor tow having a large degree of fineness and a flattened shape in cross section is thrown into a packaging container through a tow supply shoot and layered therein, and a method and a device for manufacturing the packaged tow, more particularly to a packaged carbon fiber precursor tow applied with a top/bottom surface identification means to identify a first surface and a second surface, the first and second surfaces respectively representing top and bottom surfaces of a front end and a back end in the carbon fiber precursor tow contained in the packaging container, and a method and a device for manufacturing such a packaged tow.

BACKGROUND ART

The carbon fibers excel in specific intensity, specific modulus, flame resistance, heat resistance, and durability. Therefore, a range of application of the carbon fibers thus technically advantageous is increasingly expanding. In recent years, thickened carbon fiber precursor tows including 50,000 filaments or more started to be used in order to improve the productivity of carbon fibers for cost reduction. In consequence of the ongoing trend, any packaged tow with such a thickened fiber tow is inevitably enlarged in size. An advantageous way to manufacture the packaged tow thus upsized is to throw the tow into a packaging container. So far were invented and disclosed variously different tow throw-in packaging techniques.

Japanese Patent Application Laid-Open No. 2006-176328 (Patent Document 1) discloses such a packaging technique. According to the packaging method disclosed in the Patent Document 1, a moisture-contained carbon fiber precursor tow having a large degree of fineness of 48,000 dtex to 720,000 dtex and a flame-proofed carbon fiber precursor tow (hereinafter, the carbon fiber precursor tow and the flame-proofed carbon fiber precursor tow are both simply called carbon fiber precursor tow) are thrown into a packaging container through a tow throw-in shoot, and a press plate on standby at a position above an end on the side of a folded end is pressed down when the packaging container reciprocated in a tow-width direction arrives at a folded end on the other side to compress the tows to obtain a packaged tow. The technique of the Document 1 is particularly characterized by setting a storage bulk specific gravity of the carbon fiber precursor tow thus packaged to at least 340 kg/m$^3$.

Japanese Patent Application Laid-Open No. 2008-121147 (Patent Document 2) discloses a packaging technique similar to the method disclosed in the Patent Document 1. According to the packaging method, a tow throw-in shoot is elevated relative to a packaging container as a tow throw-in top in the packaging container rises to a higher level. The method is particularly characterized in that a distance a (mm) between a lowest position on a tow lead-out end and the tow throw-in top, a thickness h (mm) of a press plate, and a minimum distance y (mm) between the press plate and the tow throw-in shoot meet a relationship expressed by the formulas; $10 \leq a \leq 400$, and $(a-h)/y \leq 3.3$, when a total degree of fineness of the tow is at least 48,000 dtex to less than 180,000 dtex.

The carbon fiber precursor tow thus packaged in the packaging container is not infinitely continuous but has a finite length, therefore, it is not possible to directly flame-proof and carbonize different tows in succession. In fact, the flame-proofing and the carbonization processes have to be suspended every time when these processes for the tow in one packaging container are over. The technical disadvantage resulted in the development of a piecing work to obtain a string of continuous tow by connecting front and back ends of tows. With this technique, the tow can be continuously flame-proofed and carbonized.

A long and continuous tow obtained by the piecing work still possibly undergoes a problem; thread breakage at joined parts of the tows due to heat accumulation particularly in the flame proofing process which generates heat. This sometimes interrupts the flame-proofing and carbonization processes desirably continuously performed. As disclosed in Japanese Patent Application Laid-Open No. 2008-150733 (Patent Document 3), for example, a thread breakage preventing technique performed prior to the piecing work was developed, wherein ends of the tows, at which the tows are joined with each other, are flame-proofed in advance.

It is disclosed in, for example, Japanese Patent Publication 47-51979 (Patent Document 4) that when a yarn continuously supplied, such as synthetic-fiber filament yarn, spanned yarn, or textured yarn, is introduced in a housing container, a front end thereof is led out of the container, ends of the yarn at its front and back are fixed to an outer surface of the housing container, and the front end of the yarn is joined with a back end of a yarn introduced in another housing container.

It is disclosed in the Patent Document 5 (Japanese Patent Application Laid-Open No. 2002-138326) that a fiber tow is cut as soon as a corrugated board box or a can is fully filled with fiber, and the cut end is knotted to prevent unraveling of the tow, or a clip-like member is applied to the tow end to prevent unraveling of the tow end.

CITATION LIST

Patent Documents

Patent Document 1: Japanese Patent Application Laid-Open No. 2006-176328

Patent Document 2: Japanese Patent Application Laid-Open No. 2008-121147

Patent Document 3: Japanese Patent Application Laid-Open No. 2008-150733

Patent Document 4: Japanese Patent Application Publication No. 47-51979

Patent Document 5: Japanese Patent Application Laid-Open No. 2002-138326

SUMMARY OF THE INVENTION

Problems to be Solved by the Invention

When the ends of a plurality of packaged carbon fiber precursor tows are thus flame-proofed and then joined with each other by the piecing work to obtain a string of continuous tow, thread breakage still possibly happens during the flame proofing process due to heat accumulation. There has been a strong call for a breakthrough to solve the problem.

An immediate object of the invention is to solve the technical problems described above. Other objects will be construed from the description given below.

Means for Solving the Problem

Faced with these technical problems, the inventors of the invention studied the technical problems through discussions and carried out various tests. Then, they finally found out that the conventional piecing work was not particularly designed not to incorrectly identify top and bottom surfaces of tows when the tows were joined with each other, therefore, the tows joined with their top and bottom surfaces the other way around were naturally twisted, and the twisted parts often underwent thread breakage due to heat accumulation. Based on this finding, the inventors of the invention reached the conclusion; a carbon fiber precursor tow can be prevented from twisting when a front end and a back end of the carbon fiber precursor tow are each applied with a top/bottom surface identification means configured to identify a first surface and a second surface respectively representing tow top and bottom surfaces. Then, they finally succeeded in accomplishing the invention.

Describing a basic technical characteristic of a packaged carbon fiber precursor tow according to the invention, a packaged tow wherein a carbon fiber precursor tow having a flattened shape in cross section and having a first surface and a second surface opposite to the first surface is layered and packaged in a packaging container in untwisted state, a front end and a back end of the carbon fiber precursor tow thus packaged are located near a top surface of the carbon fiber precursor tow fully layered including the packaging container, and there is no twist in a part of the carbon fiber precursor tow from a bottom part of the packaged carbon fiber precursor tow to a front end of the carbon fiber precursor tow on the top surface thereof.

Preferably, top/bottom surface identification means configured to identify the first surface and the second surface of the carbon fiber precursor tow are respectively provided at the front end and the back end of the tow. The top/bottom surface identification means configured to identify the first surface and the second surface is preferably a means configured to fix the end of the carbon fiber precursor tow to a top surface indicator. A width dimension of the carbon fiber precursor tow flattened in cross section is preferably at least 15 times larger than a thickness dimension thereof, and a total degree of fineness of the carbon fiber precursor tow is preferably 48,000 dtex to 720,000 dtex.

Preferably, at least one of the ends of the carbon fiber precursor tow is flame-proofed. More preferably, the front end and the back end of the carbon fiber precursor tow are respectively housed in storage bags. The front end, the back end or both of the carbon fiber precursor tow is wound in a length of 2to 10m around the top/bottom surface indicator.

Describing a basic technical characteristic of a method for manufacturing a packaged tow according to the invention, a method for manufacturing a packaged tow wherein a carbon fiber precursor tow having a first surface and a second surface opposite to the first surface and a flattened shape in cross section and also having a large degree of fineness in total from 48,000 dtex to 720,000 dtex is supplied into a packaging container through a tow supply shoot and layered therein, the method including: leading out a front end in a predefined length of the carbon fiber precursor tow supplied through the tow supply shoot from the packaging container in untwisted state and holding the lead-out front end before starting to supply the tow into the packaging container; moving a tow lead-out port of the tow supply shoot with the carbon fiber precursor tow downward to a throw-in start position on a bottom section of the packaging container while still holding the lead-out front end before starting to supply the tow into the packaging container; and starting to supply the tow into the packaging container after the tow lead-out port arrives at the tow throw-in start position.

Most preferably, the holding the lead-out front end of the carbon fiber precursor tow outside of the packaging container includes retaining a part of the tow from the front end of the tow to the lead-out port in untwisted state. While holding the lead-out front end of the carbon fiber precursor tow, the front end of the tow can be held by an air sucker. Thus, the front end of the tow is preferably retained in untwisted state by a tow front end holding means. While holding the lead-out front end of the carbon fiber precursor tow, it is desirable that the carbon fiber precursor tow be temporarily fixed at a tow passing position provided on an upper opening of the packaging container by a temporary fixing means.

While holding the lead-out front end of the carbon fiber precursor tow outside of the packaging container, the tow lead-out port of the tow supply shoot may be located outside of the packaging container and moved to an opening position immediately above the supply start position on the bottom section of the packaging container after the front end is led out and held, or the tow lead-out port may be temporarily immovably located at the opening position immediately above the supply start position on the bottom section of the packaging container until the tow lead-out port of the tow throw-in shoot starts to move downward after the holding the lead-out front end of the carbon fiber precursor tow outside of the packaging container starts.

More preferably, the method further includes: applying a top/bottom surface identification means configured to identify the first surface and the second surface to the front end of the tow during the holding of the lead-out front end of the carbon fiber precursor tow before completing the layer stacking of the carbon fiber precursor tow in the packaging container; and applying a top/bottom surface identification means configured to identify the first surface and the second surface to a surface of the back end of the tow on the same side as the front end of the tow when the layer stacking of the carbon fiber precursor tow in the packaging container is completed. Before applying the top/bottom surface identification means to the front end and/or the back end of the carbon fiber precursor tow, the front end and/or the back end of the tow are preferably flame-proofed.

The top/bottom surface identification means preferably has a top/bottom surface indicator configured to identify the first surface and the second surface of the carbon fiber precursor tow. The top/bottom surface identification means is a temporary fixing means for fixing same ones of the first surfaces or the second surfaces on the ends of the tow which are the front end and the back end of the carbon fiber precursor tow to the top/bottom surface indicator such that the same surfaces are directed in a direction. The method preferably further includes winding at least the front end in the ends of the tow in a length of 2 to 10 m from the front end of the tow around the top/bottom surface indicator in untwisted state. The method may further include: housing the front end and the back end of the tow temporarily fixed to the top/bottom surface indicator respectively in storage bags when the layer stacking of the carbon fiber precursor tow in the packaging container is completed; and locating the front end and the back end of the tow housed in the storage bags near the top of the multilayered tow including the packaging container.

Describing a basic technical characteristic of a device for manufacturing a packaged tow according to the invention, a device for manufacturing a packaged tow wherein a carbon fiber precursor tow having a first surface and a second surface and a flattened shape in cross section and also having a large degree of fineness in total from 48,000 dtex to 720,000 dtex is supplied into a packaging container through a tow supply shoot in untwisted state and layered therein, and a tow lead-out port of the tow supply shoot can be moved from a predefined standby position near an upper opening of the packaging container before the supply of the tow into the packaging container starts to a tow throw-in start position preset on a bottom section of the packaging container when the supply of the tow into the packaging container starts, the device including: a tow front end nipping means configured to nip a front end of the carbon fiber precursor tow supplied through the tow throw-out port before the tow starts to be throw in; and a tow front end holding means configured to temporarily nip or hold a front end of the tow in a predefined length drooping in a loop-like shape between the tow front end nipping means and the tow lead-out port in untwisted state.

Most preferably, the device further includes a top/bottom surface identification means configured to identify the first surface and the second surface on supply-side front and back ends of the carbon fiber precursor tow. The top/bottom surface identification means has a top/bottom surface indicator configured to identify the first surface and the second surface of the carbon fiber precursor tow. As described earlier, same ones of the first surfaces or the second surfaces on the ends of the tow which are the front end and the back end of the carbon fiber precursor tow are temporarily fixed to the top/bottom surface indicator such that the same surfaces are directed in a direction.

Preferably, the tow front end nipping means configured to grip the front end of the tow is an air sucker, and the tow front end holding means configured to hold the front end of the tow has a pair of nipping members or a holding member, wherein at least one of the pair of nipping members can move toward and away from the other one of the pair of nipping members, and the nipping members nip a front end of the tow drooping in a loop-like shape between the tow front end nipping means and the tow lead-out port when the nipping members are in proximity to each other. When the single holding member is provided as the tow front end holding means, the holding member can move in an arc shape between immediately below the tow lead-out port of the tow supply shoot and the tow front end nipping means to catch and nip the tow drooping in a loop-like shape between the tow throw-out port and the tow front end nipping means and retains the loop-like shape. The nipping members and the holding member, though not particularly limited, desirably include a plate member having a smoothened surface or a rod member having an arbitrary sectional surface. Desirably further provided is a temporary fixing means configured to temporarily fix in untwisted state a part of the tow between the tow lead-out port and the tow holding means holding or nipping the drooping loop-like tow using the pair of nipping members.

Effect of the Invention

According to the invention, when tows respectively having first and second surfaces are joined with each other in a carbon fiber precursor tow piecing work, the tows can be reliably joined with same-side surfaces of the joined ends being directed in a direction. This prevents such a trouble as the occurrence of thread breakage in a flame-proofing process due to any twist generated in the tows during the piecing work. If top and bottom surfaces are misjudged when tows are joined particularly in a tow in which a few small tows are combined, thread guides cross with each other, which may result in irregular fuzz due to friction or thread breakage due to heat accumulation in the twisted parts. The invention can successfully prevent this possible trouble from happening.

According to the packaged tow provided by the invention, the top/bottom surface indicator which is a structural element of the top/bottom surface identification means is wound around by the front end and/or back end in a predefined length of the carbon fiber precursor tow applied with the top/bottom surface identification means which helps to identify the first surface or the second surface, and the tow-wound parts are wrapped in the storage bags and placed on the top surface of the packaged multilayered tow. Then, directions of the surfaces on the front and back ends can be reliably determined in the tow piecing work by simply unwinding the front and back ends of the tow on the tow-wound parts. Moreover, required lengths of the front and back ends are thereby reliably obtained, and the ends of the tow can be easily and effectively joined with each other.

When the packaging technique disclosed in the Patent Document 1 is applied to a part of the technical characteristics of the method and the device according to the invention, the tow thrown into the packaging container and layered therein can be consistently prevented from twisting during a time period when oscillation of the tow throw-in shoot starts and ceases. Therefore, when the front end of the tow is led out of the packaging container which is a part of the technical characteristics of the invention, a part of the tow from the drooping front end of the tow held like loop by the temporary fixing means to the tow lead-out port is temporarily held in untwisted state while the front end of the tow is being led out of the packaging container and then held. This ensures that untwisted state between the front end of the tow and the throw-in start position on the bottom section of the packaging container is retained. As a result of the synergistic effect of these technical advantages, the first and second surfaces are unfailingly discriminated from each other, and there is no twist starting at the jointed parts. As a result, such a disadvantage as thread breakage due to heat accumulation in any twisted part during the flame proofing process no longer occurs.

BEST MODE FOR CARRYING OUT THE INVENTION

Figure 1:
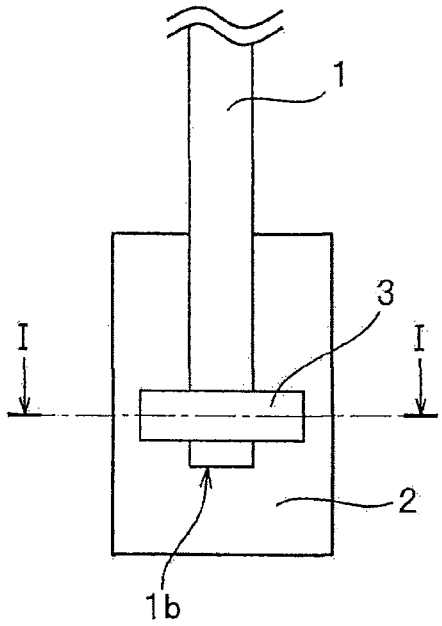
FIG. 1 is a schematic illustration of an example in which a top/bottom surface identification means of a tow is applied.

Hereinafter, an exemplary embodiment of the invention is described in detail referring the accompanying drawings.

A typical example of the "tow supply shoot" according to the invention is a "tow throw-in shoot" disclosed in the Patent Document 1. The tow throw-in shoot is oscillated when a tow is packaged in the packaging container. As a result of the oscillation, a first surface of the tow is directed upward and a second surface of the tow is then directed upward so that the tow is layered in untwisted state. There is a tow supply shoot configured differently to the tow throw-in shoot. The tow supply shoot is configured to spirally supply the tow into the packaging container while rotating a cylindrical packaging container in one direction and also rotating the shoot per se around a rotational axis set at a position displaced from a rotational center of the packaging container. The tow supply shoot can provide a packaged tow multilayered in untwisted state similarly to the tow-throw-in shoot.

The "tow throw-in shoot" used in the entire description hereinafter given is the "tow supply shoot", however, other shoots differently configured may be used.

<Packaging Tow>

A packaged tow according to the invention is a packaged tow wherein a carbon fiber precursor tow having a flattened shape in cross section and having a first surface and a second surface opposite to the first surface, and a front end and a back end of the carbon fiber precursor tow are each applied with a tow top/bottom surface identification means. Hereinafter, technical terms used in this specification are described.

<Carbon Fiber Precursor Tow>

According to the invention, a carbon fiber precursor tow is a tow formed from a bundle of a larger number of continuous mono filaments, wherein carbon fiber is obtained when heat treatments such as flame proofing and carbonizing processes are applied thereto. The carbon fiber precursor tow includes a generally called flame-proofed fiber precursor tow. The tow may be a straight tow or a crimpled tow. Such a tow is likely to undergo such troubles, for example, thread breakage when later subjected to the flame proofing processes. The invention provides a novel solution for avoiding such a trouble.

The invention is applied to a tow having a flattened shape in cross section, wherein the tow has a first surface and a second surface. The "flattened shape" used in this specification is a shape of the tow having a width dimension representing at least 4 when a thickness dimension of the tow represents 1. In the tow thus flattened in cross section, the first surface and the second surface, which are respectively a top surface and a bottom surface, can be identified because of the structure unlike a tow having a circular shape in cross section. The top and bottom surfaces of the tow cannot be discriminated from each other from their external appearances which appears to be the same, therefore, the invention calls the top and bottom surfaces the first surface and the second surface, respectively. More specifically describing the flattened shape in cross section, the tow desirably has a width dimension representing at least 15 when the thickness thereof represents 1, more specifically, the width dimension of the tow is desirably 15 times larger or more desirably 30 times larger than the thickness of the tow. For example, a ratio between tow thickness and tow width ranges from 1:35 to 1:70. In the case where the width dimension of the tow is not as large as 15 times of the thickness dimension, such a trouble as thread breakage due to heat accumulation more likely to occur if the tow is twisted. In any shapes where the width dimension is at least 15 times larger than the thickness dimension, the first surface and the second surface can be easily identified based on the top/bottom surface identification means, and thread breakage can be more effectively prevented from happening.

Though a total degree of fineness of the tow is not particularly limited, a large degree of fineness which is advantageous for a tow throw-in packaging method, for example, 48,000 dtex to 720,000 dtex, is preferable. The thread breakage preventing effect according to the invention is more evidently confirmed in such a tow having a larger degree of fineness.

At least one of a front end and a back end of the tow is preferably flame-proofed in advance to avoid the occurrence of thread breakage due to heat accumulation. More preferably, the front and back ends of the tows both are flame-proofed in advance. The flame-proofing can be performed to the front and back ends in, for example, 0.3 to 1.0 m from the respective ends.

<Tow Top/Bottom Surface Identification Means>

The top/bottom surface identification means according to the invention is applied to the front and back ends of the tow. The top/bottom surface identification means is only required to identify the first surface and the second surface (hereinafter, called top surface and bottom surface) from their external appearances. The top/bottom surface identification means may include physically arresting the ends of the tow, preventing reversal of the top and bottom surfaces using a physical force though not necessarily arresting the ends of the tow, and adhering an object to one surface of the tow, more specifically includes indication by coloring one surface of the tow, indication by bonding an adhesive tape to one or both surfaces of the tow, indication by securely nipping the tow using a tool like a clothespin, indication by securing the tow to a top/bottom surface indicator having a rectangular or other shapes, and indication by housing the tow in a bag-like member which helps to identify the top and bottom surfaces of the tow. The top/bottom surface identification means is not necessarily limited to any one of these indications, and these indications may be arbitrarily combined.

Preferably, the tow is fixed to a plate-shape member by an adhesive tape. A specific example of the plate-shape piece is a corrugated board piece which is inexpensive and less likely to damage the carbon fiber precursor tow. The tow is attached and fixed to the corrugated board piece by an adhesive tape. When the ends of the tow are thus secured, the ends of the tow are not unraveled or damaged. The top/bottom surface identification means is applied to the front and back ends of the tow both, for example, the top/bottom surface identification means is applied to the front and back ends in approximately 10 m at most from the ends of the tow. For example, the top/bottom surface identification means according to the invention can be applied in 50 cm from the ends of the tow.

FIG. 1 is a schematic illustration of an example in which the top/bottom surface identification means is applied to the front end of the tow. A carbon fiber precursor tow 1 is structurally characterized in that a bottom surface of the tow 1 is located closely facing a plate-shape member 2, which is a top/bottom surface indicator constituting a part of the top/bottom surface identification means, with a top surface of the tow 1 located on the upper side in the flame proofing being directed upward. The bottom surface is then bonded to the plate-shape member 2 by an adhesive tape 3 constituting a part of the top/bottom surface identification means. A back end of the tow 1 is similarly bonded to the plate-shape member with a top surface thereof being directed upward. Then, the top and bottom surfaces of the tow can be discriminated from each other and correctly identified when the front end and the back end of the tow 1 are joined. As a result, such a trouble as thread breakage can be prevented from happening in the flame proofing due to any twist generated in the tow 1 during the piecing work.

Figure 2:
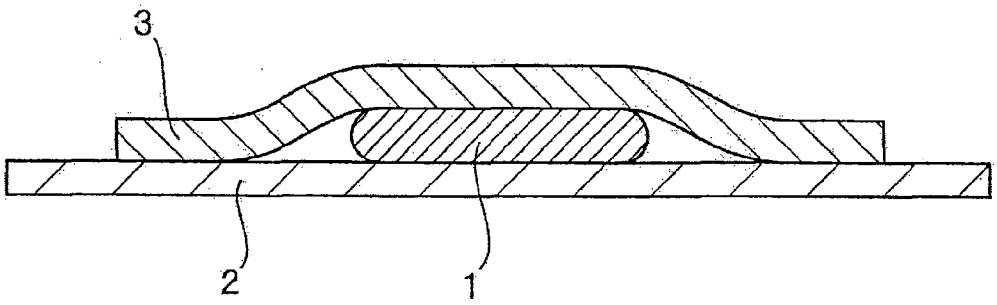
FIG. 2 is a sectional view of the top/bottom surface identification means illustrated in FIG. 1 cut along I-I.

FIG. 2 is a sectional view of the ends of the tow applied with the top/bottom surface identification means illustrated in FIG. 1 cut along I-I. The carbon fiber precursor tow 1 is bonded to the plate-shape member 2 by the adhesive tape 3 such that the bottom surface of the tow 1 is directed downward and in close contact with the plate-shape member 2 and the top surface of the tow 1 is directed outward.

Figure 3:
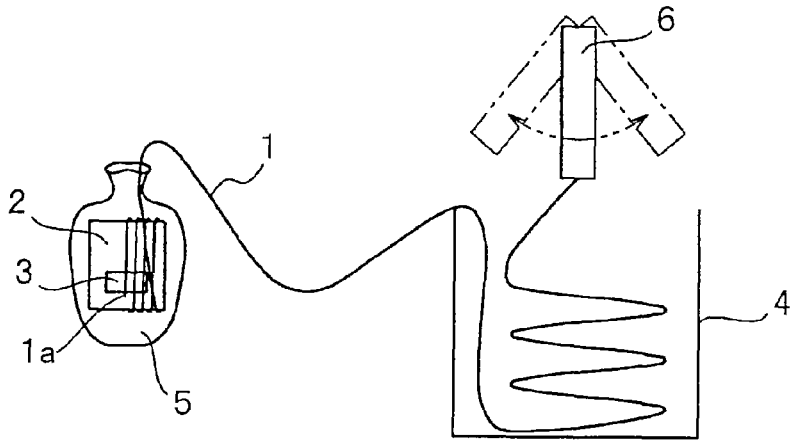
FIG. 3 is a schematic illustration of a state in which an end of the tow is wound around a plate-shape member which is a structural element of the top/bottom surface identification means.

FIG. 3 is a schematic illustration of a state in which the front end of the tow 1 illustrated in FIG. 1 is attached to the plate-shape member 2 which is an example of the top/bottom surface indicator and the front end of the tow 1 in a predefined length is wound around the plate-shape member 2. When the front end and/or the back end of the tow 1 is wound around the plate-shape member 2 in a length of 2-10 m, the piecing work can use the tow in an enough length. This improves the workability of the piecing work, and also makes it unlikely that the adhesive tape 3 peels off. When the end of the tow 1 is thus wound around the plate-shape member 2 and the tow-wound part is housed in a storage bag, there is a less distance between the storage bag in which the tow end is housed and a part of the tow led out from the bottom section of the packaging container. This significantly reduces the likelihood that the same-side surfaces of the tow 1 are joined because the tow 1 is twisted through 360 degrees therebetween, thereby twisting the tow 1.

Figure 4:
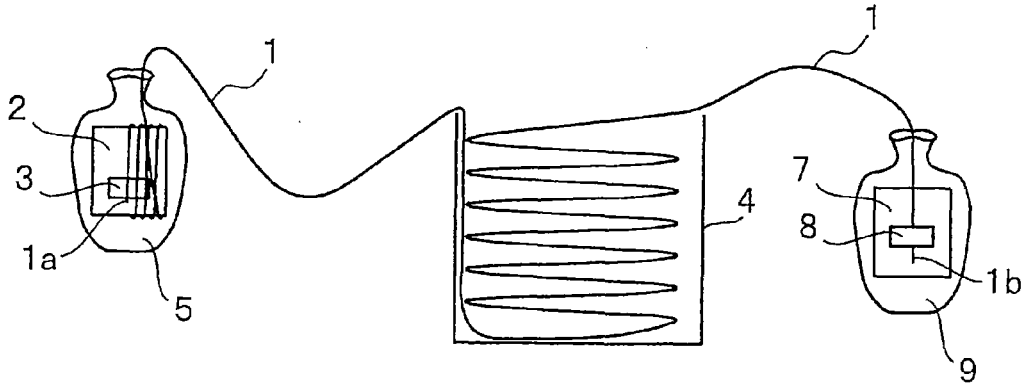
FIG. 4 is a schematic illustration of an example in which a tow is supplied into a packaging container and layered to be packaged.
Figure 5:
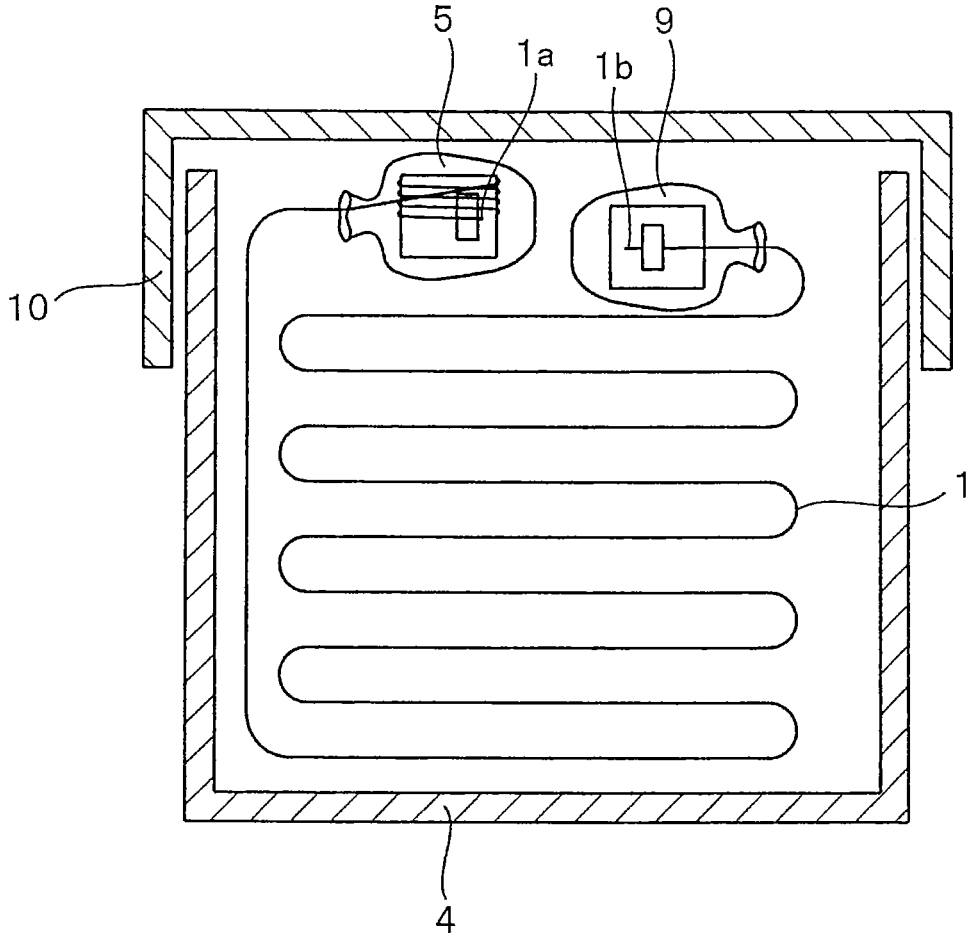
FIG. 5 is a schematic illustration of an example in which a front end and a back end of a tow applied with top/bottom surface identification means and wrapped in storage bags.
Figure 6:
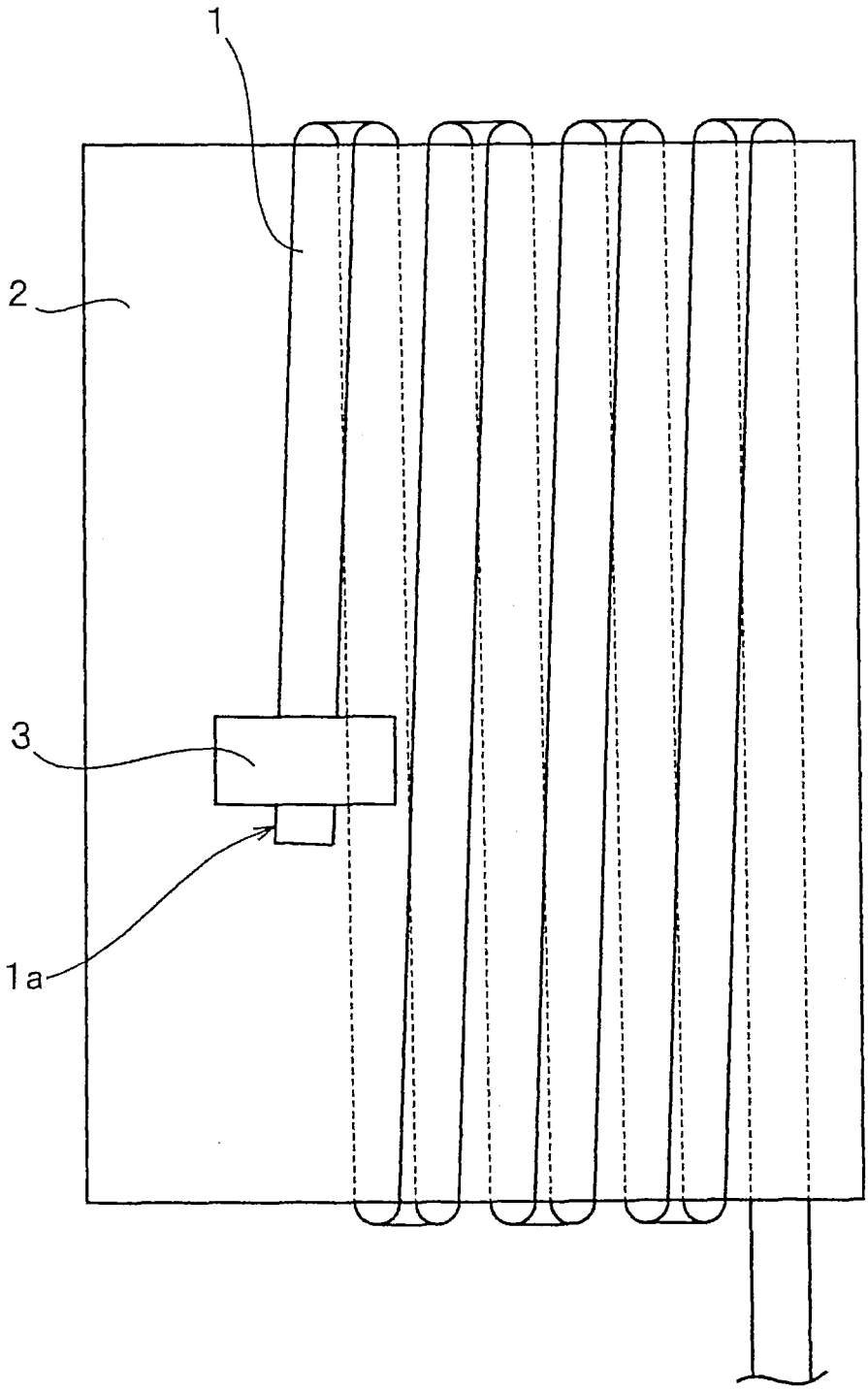
FIG. 6 is a schematic illustration of an example wherein the front end and the back end of the tow are housed in a packaged tow.

The top/bottom surface indicator wound around by the tow 1 is not necessarily limited to the plate-shape member 2. The member may have a circular shape in cross section or a bar-shape member having an elliptical shape in cross section, or a cylindrical member may be used. As illustrated in FIGS. 4 and 5, the top/bottom surface indicators wound around by the tow 1 and housed in storage bags 5 and 9 are placed on the top surface of the tow 1 fed already layered in a packaging container 4. As illustrated in FIG. 6, the top/bottom surface indicator is nipped between the tow 1 and a cap 10 of the packaging container and then housed, therefore a winding shape of the tow 1 is not lost. Moreover, a load is unlikely to be applied to the tow 1 and the cap 10 nearby because the top/bottom surface indicator wound around by the end of the tow 1 has such a plate shape.

<Packaging Container>

Though the shape of the packaging container 4 in which the tow 1 is housed is not particularly limited, an example of the packaging container is a rectangular container having inner dimensions; longitudinal dimension in the range of 500 to 1,500 cm, lateral dimension in the range of 500 to 1,500 cm, and depth dimension in the range of 800 to 1,500 cm.

Though a material of the packaging container 4 in which the tow 1 is housed is not particularly limited, a corrugated board, for example, may be used. A preferable example is a packaging container body formed from a corrugated board, and a non-moisture permeable interior member provided inside of the packaging container body, the interior member having a shape substantially equal to that of an inner shape of the packaging container body and a thickness equal to or smaller than 0.1 mm (for example, polyethylene sheet having a large tensile force). Such an interior member preferably prevents the corrugated board from absorbing any moisture from the tow 1 whenever the moisture-contained tow 1 is thrown into the packaging container, and also prevents the tow 1 from undergoing any damage such as abrasion and scratches caused by the corrugated board.

<Method of Manufacturing Packaged Tow>

The packaged tow is typically manufactured by throwing the tow 1 into the packaging container 4. Preferably, a front end 1*a* is led out of the packaging container 4 so that there is a predefined distance between the front end 1*a* of the tow 1 and a tow feeding port 6*a* of a tow throw-in shoot 6 before starting to throw-in of the tow 1. Accordingly, untwisted state is retained between the front end 1*a* and the feeding port 6*a* to hold the front end in a predefined length. The tow 1 starts to be fed into the packaging container with untwisted state being retained to manufacture the packaged tow. Then, the tow 1 can be packaged in the packaging container 4 with the front end 1*a* being left out of the packaging container 4. This manufacturing method is advantageous in that the piecing work for joining the top with the back end 1*b* of the packaged tow 1 that follows can be easily performed with untwisted state being retained.

A part of the tow led out of the packaging container 4 through the feeding port 6*a* of the tow throw-in shoot 6 before starting to feed the tow 1 has to be retained untwisted. To this end, the following two methods for leading out and holding the tow are available depending on a standby position of the tow throw-in shoot 6 before the tow 1 starts to be fed through the tow throw-in shoot 6. A length of the tow end to be held is 2 to 10 m in view of operability of the piecing work performed later.

First and second methods are described in detail referring to different operation steps illustrated in FIGS. 7 to 11. The operation steps of the first and second methods and operation steps of structural elements of a device for implementing the methods are automatically controlled based on programs set in a controller not illustrated in the drawings.

Figure 7:
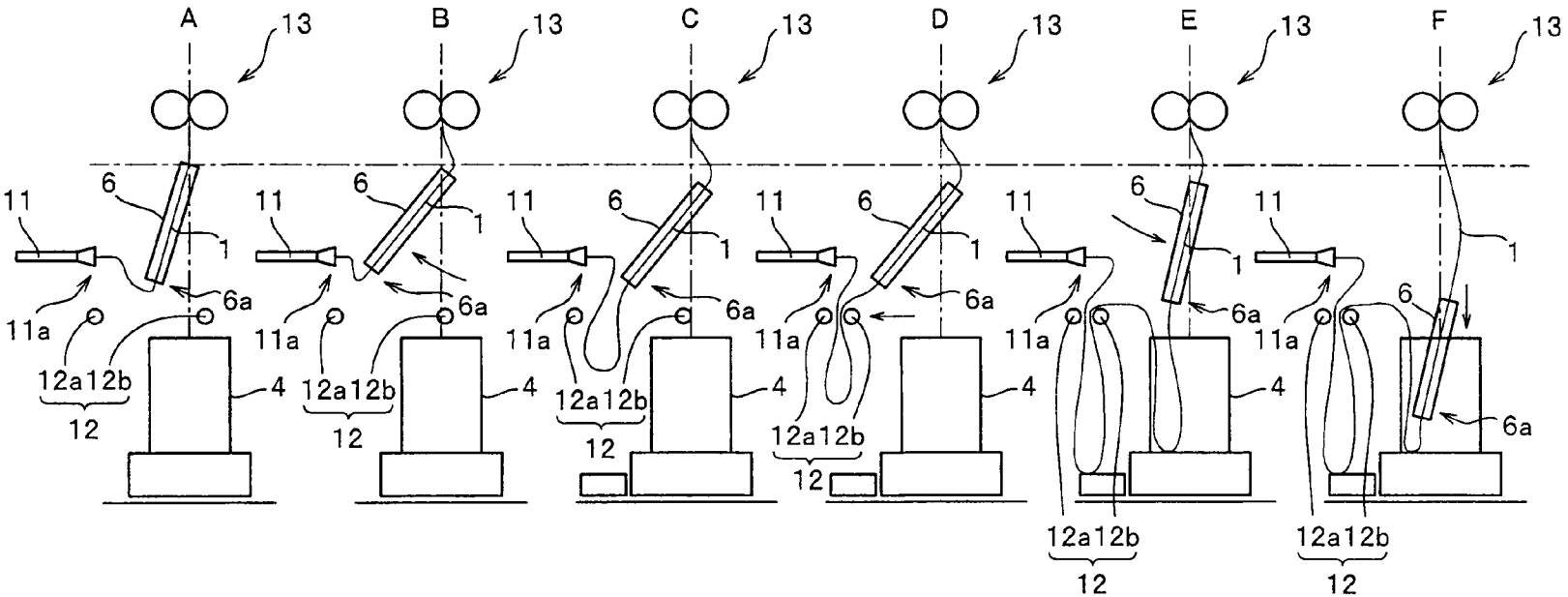
FIG. 7 is a schematic illustration of an example of tow throw-in steps before starting to supply the tow into the packaging container.

FIG. 7 illustrates the first method. The first method is implemented when a maximum oscillation range of the tow feeding port 6*a* of the tow throw-in shoot 6 is as large as the oscillation reaches an outward position beyond the packaging container 4. The maximum oscillation range is set to such an oscillation width that the tow 1 fed through the tow feeding port 6*a* drops outside of the packaging container 4. Similarly to the prior art, the oscillation width of the tow throw-in shoot 6 when the tow 1 is fed into the packaging container 4 is substantially equal to a distance between inner surfaces of the packaging container facing each other in a direction where the tow throw-in shoot 6 oscillates.

According to the first method, before the tow 1 starts to be fed, the tow throw-in shoot 6 provided in an upper direction of the packaging container 4 is oscillated from a regular throw-in position illustrated in FIG. 7A to a position illustrated in FIG. 7B which is a maximum oscillation position of the tow throw-in shoot 6, and the oscillation of the tow feeding port 6*a* is suspended on an outer side of an upper opening of the packaging container 4. Then, the tow 1 fed through tow feeding port 6*a* directed toward a floor surface near the packaging container 4 drops on the floor surface under its own weight.

According to the present exemplary embodiment, an air sucker 11, which is one of structural elements of the tow front end nipping means according to the invention, is provided at a lateral position adjacent to the tow feeding port 6*a* to nip the front end of the tow 1 falling downward while retaining untwisted state. Other examples of the tow front end nipping means according to the invention are a wind-up roll configured to wind up the front end of the tow 1 in a predefined length, and a tow supply gear roll configured to suspend rotation as soon as the feed of the front end of the tow 1 in a predefined length is finished. The air sucker is preferably used in view of operability, safety, and structural simplicity.

Moreover, a tow front end holding means 12 according to the invention is provided at a position in an upper direction of a suction port 11*a* of the air sucker 11 and the packaging container 4 and below a part not interfering with the tow feeding port 6*a* during the oscillation. The tow front end holding means 12 has first and second nipping members 12*a* and 12*b*. The first nipping member 12*a*, which is one of the nipping members, is immovably located substantially immediately below the suction port 11*a* of the air sucker 11. The second nipping member 12*b*, which is the other nipping member constituting the tow front end holding means 12, is provided reciprocatably in a horizontal direction in a part near the upper opening of the packaging container 4 and not interfering with the tow feeding port 6*a* of the tow throw-in shoot 6 during the oscillation. According to the present exemplary embodiment, the first and second nipping members 12*a* and 12*b* are formed from round bar members having equal dimensions and horizontally provided orthogonal to an oscillation plane of the tow throw-in shoot 6 as illustrated in FIG. 7.

Steps for holding the front end of the tow 1 according to the first method are described in detail referring to FIG. 7.

The tow throw-in shoot 6 configured to oscillate on an oscillation center in an upper central part of the empty packaging container 4 in a direction where the tow 1 is fed in is provided. A gear roll 13 for supplying the tow is provided on an upstream side of the tow throw-in shoot 6. Before starting to feed the tow 1 by oscillating the tow throw-in shoot 6, the tow throw-in shoot 6 is perpendicularly positioned. To temporarily securely hold the front end in a predefined length of the tow 1 supplied through the tow feeding port 6*a* of the tow throw-in shoot 6, the tow feeding port 6 is oscillated in one direction as far as the maximum oscillation width, and then halted at the position as illustrated in FIG. 7A. At the time, the suction port 11*a* of the air sucker 11 is directed toward vicinity of the tow feeding port 6*a* of the tow throw-in shoot 6, therefore, the front end 1*a* of the tow 1 supplied through the tow feeding port 6*a* of the tow throw-in shoot 6 is immediately suctioned and held by the air sucker 11.

After the front end of the tow 1 is thus suctioned, the tow 1 is continuously supplied through the tow feeding port 6*a* of the tow throw-in shoot 6. The tow 1 thus continuously supplied then starts to droop in a loop-like shape between the first nipping member 12*a* and the second nipping member 12*b* located at positions distant from each other as illustrated in FIG. 7B, and then forms a loop in a required length at the front end of the tow 1 as illustrated in FIG. 7C. The length of the loop at the time is 2 to 10 m as described earlier. When the look-like tow 1 thus formed reaches the length of the front end, the second nipping member 12*b* moves toward the first nipping member 12*a* immovably positioned so that an upper end of the front end of the loop-like tow is thereby nipped and held (see FIG. 7D).

When the upper end is thus nipped and held, the tow throw-in shoot 6 halted at the position oscillates to a predefined position of the packaging container 4 as illustrated in FIG. 7E. The predefined position is an upper position in the upper opening immediately above a tow throw-in start position near the bottom section of the packaging container 4. All the while, the tow 1 continues to be supplied, therefore, the tow 1 follows the motion of the tow feeding port 6*a* of the tow throw-in shoot 6. The tow feeding port 6*a*, as soon as reaching the upper position in the upper opening of the packaging container 4 immediately above the tow throw-in start position, starts to move downward straight to the tow throw-in start position in the packaging container 4. When the tow throw-in shoot 6 thus moving downward is halted, the front end of the tow 1 suctioned and held by the air sucker 11 is cut off near the suction port 11*a* as illustrated in FIG. 7F.

Then, the tow throw-in shoot 6 is oscillated to start a normal throw-in operation and the oscillation continues until the packaging container 4 is fully filled with the tow 1. Then, the tow 1 throw-in operation ends. When the tow 1 throw-in operation ends, a cut end of the tow 1 nipped by the air sucker 11 (front end 1*a* of the tow) and the back end 1*b* of the tow 1 when the throw-in operation ends are respectively applied with the top/bottom surface identification means. Describing the application of top/bottom surface identification means then, as described earlier referring to FIG. 3, the same-side surfaces of the tow front end 1*a* and the tow back end 1*b* are brought into close contact with the plate-shape member 2 and then bonded thereto by the adhesive tape 3. The tow 1 is then wound around the plate-shape member 2 in untwisted state and housed in the storage bags 5 and 9 each formed from, for example, a transparent polyethylene film as illustrated in FIGS. 4 and 5.

The tow front end and the tow back end housed in the storage bags 5 and 9 are placed on the top surface of the multilayered tow in which the fed tow is stacked in folded layers, and the upper opening of the packaging container 4 is sealed with the cap 10 as illustrated in FIG. 6.

Though the tow 1 is directly fed into the packaging container 4 according to the drawings, the invention may provide a container having an inner shape similar to that of the packaging container 4, which is not being illustrated in the drawings, in the packaging container 4 beforehand as described earlier, wherein the tow 1 may be thrown into the wrapping member and then packaged.

<Second Method>

So far is described in detail the first method of holding the tow front end according to the invention. The second method is described below referring to FIG. 8. The structural elements substantially similar to those of the first method are given the same reference numerals.

Figure 8:
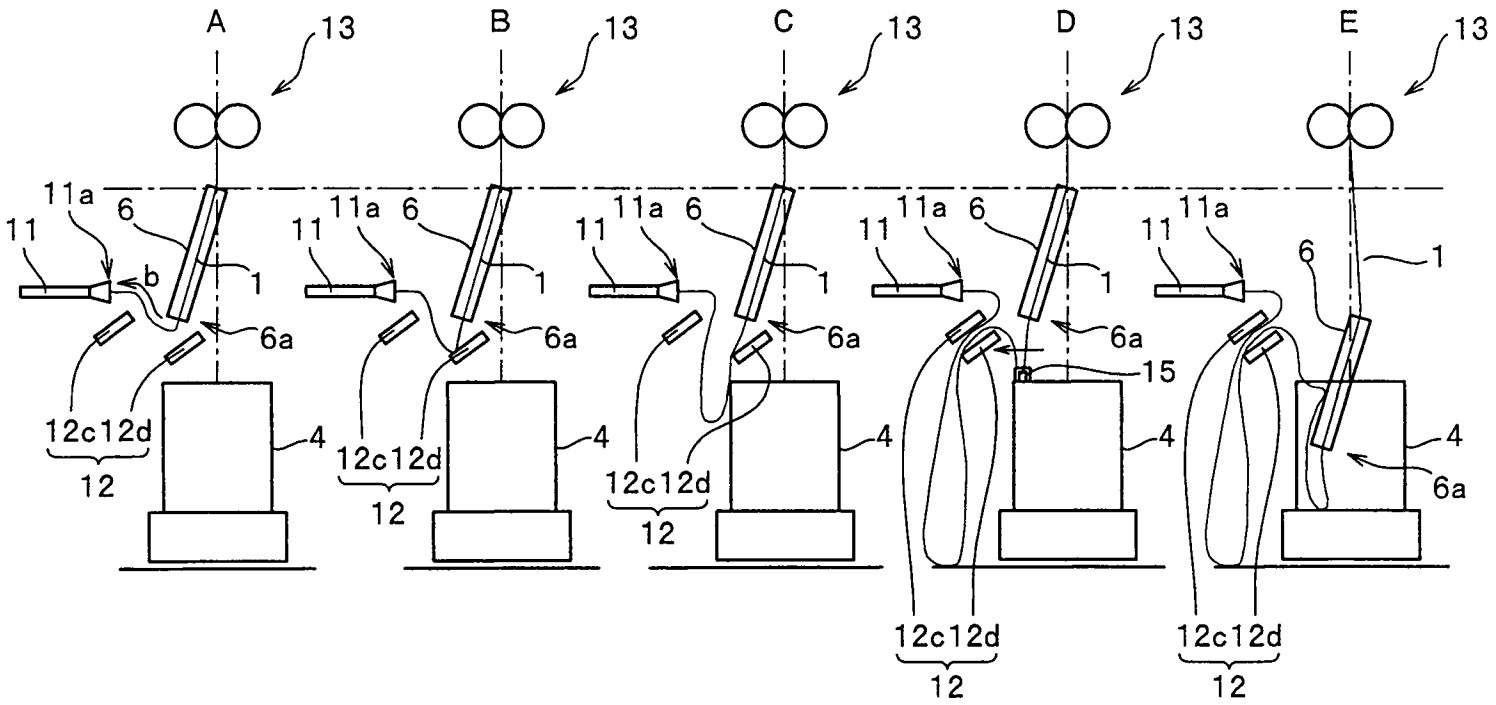
FIG. 8 is a schematic illustration of another example of tow supply steps before starting to supply the tow into the packaging container.

FIG. 8 is an illustration of the second method. According to the second method, a maximum oscillation range of the tow feeding port 6*a* of the tow throw-in shoot 6 is set to such an oscillation width that the tow supplied through the tow feeding port 6*a* drops on folded ends inside the packaging container 4. Similarly to the description earlier, the oscillation width of the tow throw-in shoot 6 when the tow 1 is fed into the packaging container 4 is substantially equal to a distance between inner surfaces of the packaging container facing each other in the direction where the tow throw-in shoot 6 oscillates.

The second method is largely different to the first method in that the tow throw-in shoot 6 before the tow 1 starts to be fed keeps a posture illustrated in FIG. 8A until the throw-in shoot 6 needs to change the posture when starting to move downward to the throw-in start position near the bottom section of the packaging container 4 illustrated in FIG. 8B. As illustrated in FIGS. 7A to 7D, the second method is characterized in that the oscillation of the tow throw-in shoot 6 is halted so that the tow feeding port 6*a* of the tow throw-in shoot 6 is located at an opening position immediately above the tow throw-in start position inside the packaging container 4 which is the maximum oscillation position. Therefore, the tow 1 fed through the tow feeding port 6*a* drops on the tow throw-in start position on the bottom section of the packaging container 4 under its own weight unless arranged otherwise.

To solve the problem, the present exemplary embodiment provides tow front end holding means 12 immediately above the tow throw-in start position and below the suction port 11*a* of the air sucker 11 which is an example of the tow front end nipping means similarly to the first method. Similarly to the first method, the second method may employ, other than the air sucker, a wind-up roll configured to wind up the front end of the tow 1 in a predefined length, and a tow supply gear roll configured to suspend rotation as soon as the feed of front end of the tow 1 in a predefined length is finished.

The tow front end holding means 12 has third and fourth nipping members 12*c* and 12*d*. The third and fourth nipping members 12*c* and 12*d* are positioned substantially immediately below the suction port 11*a* of the air sucker 11 before holding the front end of the tow. The third and fourth nipping members 12*c* and 12*d* are formed from long plate members having equal dimensions. As illustrated in FIG. 8, the third and fourth nipping members 12*c* and 12*d* are situated to be orthogonal to the oscillation plane of the tow throw-in shoot 6 and horizontal in a lengthwise direction, and further tilted downward toward an outer side of the throw-in direction in parallel with each other. Of the third and fourth nipping members 12*c* and 12*d* thus provided in a pair, the third nipping member 12*c* is immovably located immediately below the suction port 11*a* of the air sucker, and the fourth nipping member 12*d* can move forward and backward between a tow drop position of the tow feeding port 6*a* near the suction port 11*a* and a position beyond the oscillation range of the tow throw-in shoot 6 as illustrated in FIG. 8A. Further, the fourth nipping member 12*d* can reciprocate horizontally in the tow throw-in direction between the tow drop position and vicinity of the third nipping member 12*c*. A gear roll 13 for supplying the tow is provided on an upstream side of the tow throw-in shoot 6.

To temporarily securely hold the front end in a predefined length of the tow 1 fed through the tow feeding port 6*a* of the tow throw-in shoot 6, the tow throw-in shoot 6 in an upright position is oscillated in one direction toward the halt position and then halted at a position illustrated in FIG. 8A. At the time, the suction port 11*a* of the air sucker 11 is directed toward the tow feeding port 6*a* of the tow throw-in shoot 6, and the fourth nipping member 12*d* moves from a retract position not illustrated in the drawings and stays on standby at the tow drop position below the tow feeding port 6*a*. Therefore, the front end 1*a* of the tow 1 dropping through the tow feeding port 6*a* of the tow throw-in shoot 6 hits a slanted upper surface of the fourth nipping member 12*d* and then looks to slip obliquely downward. However, air around the suction port 11*a* of the air sucker 11 starts to flow in a direction b of the suction port 11*a* under the influence of the third nipping member 12*c*. Because of the airflow, the front end of the tow about to drop is immediately suctioned into the suction port 11*a* and thereby held.

After the front end of the tow 1 is thus suctioned, the tow 1 still continues to be fed through the tow feeding port 6*a* of the tow throw-in shoot 6. The tow 1 thus continuously supplied starts to droop in a loop-like shape between the third nipping member 12*c* and the fourth nipping member 12*d* located at positions distant from each other as illustrated in FIG. 8B, and then forms a loop in a required length at the front end of the tow 1 as illustrated in FIGS. 8C and 8D. The length of the loop at the time is 2 to 10 m as described earlier. When the loop-like tow 1 thus formed reaches the length of the front end, the fourth nipping member 12*d* moves toward the third nipping member 12*c* immovably positioned so that an upper end of the front end of the loop-like tow is thereby nipped and held (see FIG. 8D).

At the time, the tow 1 still continues to be fed through the tow feeding port 6*a* of the tow throw-in shoot 6, and the tow 1 thus supplied through the tow feeding port 6*a* passes over an upper edge of the packaging container 4 and then falls toward the bottom section of the packaging container. According to the present exemplary embodiment, after confirming that there is no twist in a part of the tow from the nipped part in the front end of the loop-like tow to the bottom section of the container, the tow 1 and the upper edge of the packaging container 4 that the tow 1 passed over are temporarily nipped and held by a clip 15. The clip 15 is an example of the temporary fixing means according to the invention. After the feed of the tow 1 starts, the clip 15 may be removed whenever appropriate.

When the tow 1 is successfully nipped and held, the tow throw-in shoot 6 at rest then starts to move downward straight to the tow throw-in start position in the packaging container 4 as illustrated in FIG. 8E. Because the tow 1 still continues to be supplied at the time, the tow 1 follows the motion of the tow feeding port 6*a* of the tow throw-in shoot 6. When the tow feeding port 6 moving downward is halted, the front end of the tow 1 suctioned and held by the air sucker 11 is cut off near the suction port 11*a* as illustrated in FIG. 8E.

Then, the tow throw-in shoot 6 is oscillated to start the normal throw-in operation and the oscillation continues until the packaging container 4 is fully filled with the tow 1, and the tow 1 throw-in operation ends. Before the feed of the tow 1 starts, the fourth nipping member 12*d* already returned to the original retract position. When the feed of the tow 1 is finished, a cut end of the tow 1 nipped by the air sucker 11 (front end 1*a* of the tow) and the back end 1*b* of the tow 1 when the throw-in operation ends are respectively applied with the top/bottom surface identification means. The front end and the back end of the tow thus applied with the top/bottom surface identification means in a manner similar to the first method are housed in the storage bags 5 and 9. The front end and the back end of the tow thus applied with the means are placed on the top surface of the package tow in which the tow is folded and layered as illustrated in FIG. 6, and the upper opening of the packaging container 4 is sealed with the cap 10. Then, the packaging is completed.

The air sucker 11 is not necessarily immovably located at the predefined position as described in the present exemplary embodiment. The air sucker 11 may be configured to move horizontally toward and away from the tow feeding port 6*a* with the suction port 11*a* thereof being directed toward the tow feeding port 6*a*. The air sucker 11 thus configured moves away from the tow feeding port 6*a* with the front end 1*a* of the tow being nipped by the air sucker 11 which is an example of the tow front end nipping means in accordance with or regardless of an amount of the tow 1 fed through the tow feeding port 6*a* of the tow throw-in shoot 6. Therefore, it becomes unnecessary to provide the first to fourth nipping means 12*a* to 12*d* used as the tow nipping means to hold the front end of the tow in the first and second methods. A distance between the moved air sucker 11 and the tow feeding port 6*a* is 2 to 10 m which is the length of the front end of the tow. When the moving distance of the air sucker 11 is limited to the numeral range, the suctioning is halted at the same time as the movement of the air sucker 11, or the movement of the air sucker 11 alone is halted. When the movement of the air sucker 11 alone is halted, the tow 1 is cut near the suction port 11*a* at the same time as the halt, and the top/bottom surface identification means is applied thereto then.

However, there are problems in moving the air sucker 11 by the given distance; it is difficult to retain the posture of the tow and the package manufacturing device requires a large space because the tow 1 having a length of 2 to 10 m is suspended in a space between the halt position of the air sucker 11 and the tow feeding port 6*a*, it is necessary to provide a more sophisticated device to move the air sucker 11, and such a device complicates the programs housed in the controller.

Figure 9:
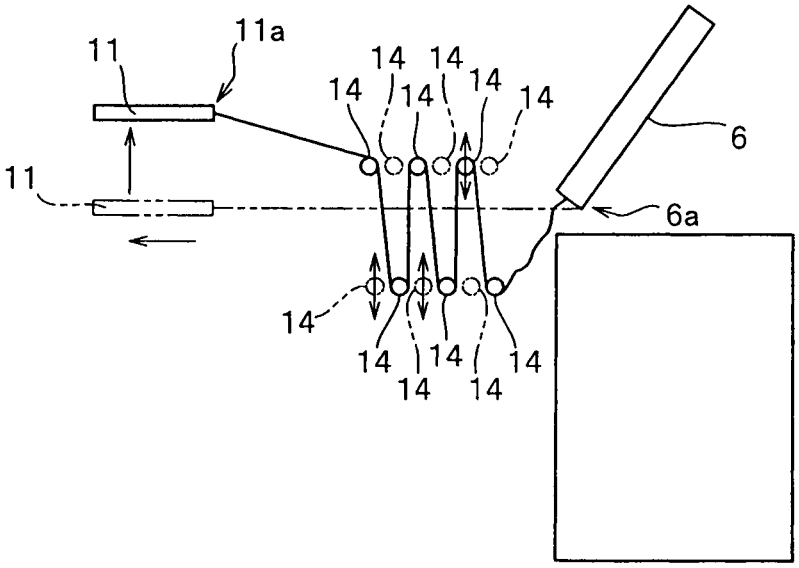
FIG. 9 is a schematic illustration of still another example of tow supply steps before starting to supply the tow into the packaging container.

To avoid these problems, the invention can solve any problems caused by moving the air sucker 11 in a long distance by securely holding the front end of the tow in a predefined length until the packaging is completed. FIG. 9 illustrates a method for moving the air sucker 11 in a shorter distance than the moving distance and securely holding the front end of the tow in a predefined length until the packaging is completed. Referring to the drawing, a plurality of guide rollers 14 are provided in a zigzag manner between the tow feeding port 6*a* and the air sucker 11. Adjacent ones of the plurality of guide rollers 14 can reverse upper and lower positions thereof. When all of the guide rollers 14 are aligned on a plane at the same time, the air sucker 11 can horizontally move in a required short distance between positions off the plane.

According to the technical characteristics, the suction port 11*a* of the air sucker 11 is located near the tow feeding port 6*a* during a standby period before the front end of the tow starts to be nipped by the air sucker 11, and the air sucker 11 starts to move as soon as the front end of the tow 1 is suctioned and nipped by the air sucker 11. At the time, the guide rollers 14 are horizontally aligned on the same plane off the travelling path of the air sucker 11. Then, the guide rollers 14 do not block the movements of the air sucker 11 and the tow 1. After the air sucker 11 moved in the required short distance, adjacent ones of the aligned guide rollers 14 are moved upward and/or downward such that the plurality of guide rollers 14 are arranged in the zigzag manner. Accordingly, the tow 1 linearly moving is guided in the zigzag manner as the plurality of guide rollers 14 move upward and downward in the zigzag manner. As a result, a required length of the front end is obtained. The guide rollers 14 may be conventional guider rollers. Other examples of the guide rollers 14 are Nelson rollers and dancer rollers.

<Modified Example of Second Method>

Figure 10:
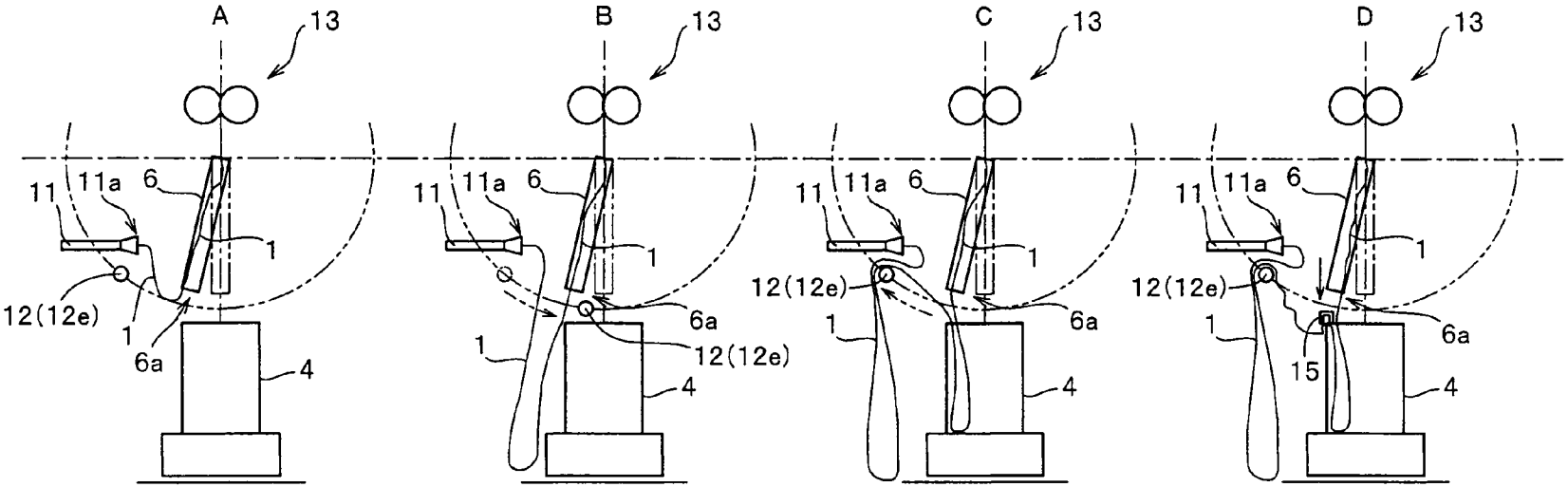
FIG. 10 is a schematic illustration of a modified example of tow supply steps before starting to supply the tow into the packaging container.

FIG. 10 illustrates a modified example of the second method according to the invention.

Referring to the drawing, a holding member 12*e* is used in place of the third and fourth nipping members 12*c* and 12*d* which are the structural elements of the tow front end holding means 12 as illustrated in FIG. 8. Any other structural elements are basically similar to those of the second method, and the tow throw-in shoot 6 operates in the same manner as the operation according to the second method illustrated in FIG. 8.

Figure 11:
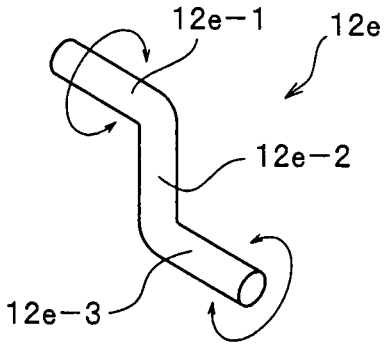
FIG. 11 is a perspective view of an example of a holding member used in the modified embodiment.

As illustrated in FIG. 11, the holding member 12*e* has a shape and a structure similar to those of a crank shaft, including a first horizontal shaft 12*e*-1, a bent shaft 12*e*-2 bent through 90 degrees at one end of the first horizontal shaft 12*e*-1, and a second horizontal shaft 12*e*-3 in parallel with the first horizontal shaft 12*e*-1 at the other end of the bent shaft 12*e*-2 and extending in a direction opposite to the first horizontal shaft 12*e*-1 from the bent shaft 12*e*-2. The second horizontal shaft 12*e*-3 is rotated on a concentric circle having a radius larger than a dimension up to the tow feeding port 6*a* of the tow throw-in shoot 6 with the first horizontal shaft 12*e*-1 serving as a rotational center which overlaps on the oscillation center of the throw-in shoot 6. The radius at the time has such a dimension that the second horizontal shaft 12*e*-3 does not interfere with the packaging container 4 while the holding member 12*e* is rotating when the tow throw-in shoot 6 is located in an upper direction of the opening of the packaging container 4.

Referring to FIG. 10, when the operation to hold the front end of the tow 1 starts, the tow feeding port 6*a* of the tow throw-in shoot 6 is oscillated to the opening position immediately above the tow throw-in start position in the packaging container 4 which is the maximum oscillation position, and the oscillation of the tow throw-in shoot 6 is halted at a position illustrated in FIG. 10A. Therefore, the tow 1 fed through the tow feeding port 6*a* drops on the tow throw-in start position on the bottom section of the packaging container 4 under its own weight unless any arranged otherwise. At the time, the second horizontal shaft 12*e*-3 of the holding member 12*e* is already immediately below the tow feeding port 6*a* of the tow throw-in shoot 6 to catch the front end of the tow 1 fed through the tow feeding port 6*a* as illustrated in FIG. 10A. At the time, air around the suction port 11*a* of the air sucker 11 flows in a direction b of the suction port 11*a*, and the suction port 11*a* immediately suctions the front end of the tow received by the second horizontal shaft 12*e*-3.

After that, the tow 1 still continues to be fed. The tow 1 thus continuously fed advances to between the suction port 11*a* and the second horizontal shaft 12*e*-3 and droops in a loop-like shape as illustrated in FIG. 10B. When the length of the loop-like tow 1 equals to the length of the front end mentioned earlier, the second horizontal shaft 12*e*-3 starts to rotate toward the suction port 11*a* and catches and retains a part of the looped tow below the suction port 11*a* as illustrated in FIG. 10C. As result of the rotation of the second horizontal shaft 12*e*-3 then, the tow 1 fed through the tow feeding port 6*a* passes over an edge of the upper opening of the packaging container 4 and then starts to droop in a loop-like shape toward the tow throw-in start position on the bottom section of the packaging container 4. At the time, there is no twist in the tow 1 between the upper opening edge and the tow throw-in start position, and the top and bottom surfaces thereof are directed similarly to those of the tow 1 drooped and held by the second horizontal shaft 12*e*-3. According to the modified example wherein the second horizontal shaft 12*e*-3 simply catches the front end of the tow, the behavior of the second horizontal shaft 12*e*-3 is possibly subject to impacts from any other members. Therefore, the modified example confirms that there is no twist in a part of the tow 1 from the bottom section of the packaging container 4 to the outside of the packaging container, and then temporarily fixes the tow without creating any twist in the part.

Unless the part is twisted, the tow may be temporarily fixed directly to the packaging container 4 or fixed to other sections in place of the packaging container 4. To directly fix the tow to the packaging container 4, the tow and the upper end of the packaging container may be nipped with a clip, or an outer surface of the packaging container 4 may be wound around by a rubber band to interpose the tow therebetween. When the tow is fixed to other sections in place the packaging container 4, the tow may be fixed by a stationary clip outside or a magnet in a bar shape or a plate shape.

To directly fix the tow 1 to the packaging container 4, the tow 1 may be nipped with a clip 15 along the upper opening edge of the packaging container 4 as illustrated in FIG. 10D. Though not illustrated in the drawings, the outer surface of the packaging container 4 may be wound around by a rubber band to interpose the tow therebetween. The fixing methods preferable in view of operability and structural simplicity are to nip the tow 1 and the edge of the upper opening of the packaging container 4 using the clip 15, and to wind the rubber band around the outer surface of the packaging container 4 not illustrated in the drawings to interpose the tow 1 therebetween. Of these preferable methods, it is recommended to nip the tow 1 and the edge of the upper opening of the packaging container 4 using the clip 15 because it is the simplest and easiest method.

During the normal throw-in operation, the tow can be prevented from twisting by the throw-in methods disclosed in the Patent Document 1 (Japanese Patent Application Laid-Open No. 2006-176328) and the Patent Document 2 (Japanese Patent Application Laid-Open No. 2008-121147). Because the back end can be easily picked up to discriminate the top and bottom surfaces from each other to know whether the tow is twisted, it is not so complicated to process the back end of the tow as to process the front end. Therefore, the end part may be knotted, however, a part of the tow is wasted as disclosed in the Patent Document 5 (Japanese Patent Application Laid-Open No. 2002-138326). To avoid such a waste, the method disclosed in the Patent Document 5 may be employed, or the tow may be bonded to the plate-shape member 2 with the top surface thereof directed upward as described earlier.

The tow 1 is discharged into the packaging container 4 through the tow throw-in shoot 6 and packaged. Referring to FIG. 4, the packaging container 4 is swung like a swing chair with an upper end of the tow throw-in shoot 6 as a swing center so that the tow 1 is regularly folded in the packaging container 4 to be packaged. The packaging container 4 may be reciprocated so that the tow 1 is regularly folded in the packaging container 4 to be packaged. When the packaging container 4 is reciprocated, the tow throw-in shoot 6 may be immovably positioned, or the packaging container 4 may be reciprocated while the tow throw-in shoot 6 is being oscillated.

FIG. 5 is a schematic illustration of a preferred state in which the front end 1*a* and the back end 1*b* of the tow 1 are applied with the top/bottom surface identification means after the feed of the tow 1 is finished. After the throw-in operation to the packaging container 4 is completed, the carbon fiber precursor tow 1 is cut, and the back end 1*b* of the tow is bonded by the adhesive tape 8 to the plate-shape member 7 which is a part of the top/bottom surface identification means such that the directions of the surfaces agree with the directions of the surfaces of the tow 1 before the throw-in operation. At the time, the plate-shape member 7 is located on the bottom surface side of the tow, and the adhesive tape 8 is attached from the top surface side of the tow. Then, the plate-shape member 7 is housed in the storage bag 9 used to house the tow back end, for example, a plastic bag. When the front end 1*a* and the back end 1*b* of the tow 1 are thus housed in the storage bags 5 and 9, these ends are prevented from being entangled with the tow 1 layered in the packaging container 4.

FIG. 6 is a schematic illustration of an example of the packaged tow in which the front end 1*a* and the back end 1*b* of the tow 1 applied with the top/bottom surface identification means are packaged. In the packaged tow, the storage bag 5 used to house the front end 1*a* of the tow and the storage bag 9 used to house the back end 1*b* of the tow are placed with the respective ends of the tow housed therein on the top surface of the tow 1 layered in the packaging container 4, and the upper opening of the packaging container is sealed with the cap 10. On the back end side of the tow 1 located in an upper part of the packaging container, the tow 1 can be easily pulled out from the bottom section of the packaging container 4 to obtain the tow in an enough length to join the tows. On the front end side of the tow located on the bottom section of the packaging container 4, it is not as easy to pull out the front end of the tow 1. Therefore, the tow is not wound around the plate-shape member on the back end side of the tow, whereas the front end in a predefined length is obtained and then wound around the plate-shape member on the front end side of the tow as illustrated in FIG. 6. To house the front end 1*a* of the tow in the packaging container 4, the plate-shape member 2 wound around by the tow 1 is taken out of the front end storage bag 5, and any part of the tow hanging out of the packaging container 4 between the plate-shape member and the packaging container is wound around the plate-shape member 2. Then, the plate-shape member is put back into the front end storage bag 5 and then housed in the packaging container 4. Unless the plate-shape member 2 is housed in the packaging container 4 after the tow 1 between the packaging container and the plate-shape member 2 is wound around the plate-shape member, the part of the tow therebetween is easily twisted. As a result, it becomes difficult to identify the top and bottom surfaces of the tow 1 in the piecing work and the flame-proofing process for flame-proofing the tow ends beforehand implemented prior to the piecing work.

The packaging container 4 where the front and back ends of the tow are housed is transferred to a carbon fiber manufacturing process and subjected to the flame-proofing process in which the tow ends are flame-proofed beforehand. The front and back ends of the tow are unwound from the plate-shape member and then set in, for example, a flame-proofing device disclosed in the Patent Document 3. The unwinding work unwinds the whole tow confirming that the tow is not twisted while unfolding the tow in the same direction of the tow throw-in direction on the top surface of the tow thrown into the packaging container and slightly shifting the unfolded tow in the tow-width direction. As far as the adhesive tape constituting the top/bottom surface indicating means is directed upward when the whole tow is unwound, it is confirmed that there is no twist in the tow between the packaging container and the plate-shape member. When the whole tow is unwound, the tow is set in the flame-proofing device such that the surface with the adhesive tape attached thereto is directed upward, and the plate-shape member is removed therefrom. Then, the tow is flame-proofed.

The flame-proofed front and back ends of the tow are bonded to the plate-shape member such that the surface with the adhesive tape is directed upward. The whole unwound tow is wound again around in untwisted state and housed in the storage bags, and then placed on an upper part of the packaging container.

The packaging container 4 in which the flame-proofed front and back ends of the tow are housed is transferred to a predefined position of the carbon fiber manufacturing process. At the position, the front end of the tow is taken out of the packaging container with the plate-shape member being attached to it, but the plate-shape member is removed from the back end of the tow. Then, the carbon fiber manufacturing process starts. The front and back ends of the tow in a next packaging container to be subjected to the piecing work are similarly flame-proofed, and the packaging container is then transferred to a position adjacent to the packaging container transferred earlier. Similarly, the unwinding work unwinds the whole front end of tow confirming that the tow is not twisted while unfolding the tow of the preceding packaging container in the same direction of the tow throw-in direction on the top surface of the tow thrown into the next packaging container and slightly shifting the unfolded tow in the tow-width direction. The front end of the tow in the preceding packaging container and the back end of the tow in the next packaging container are put together facing each other such that the tape-attached surfaces are directed upward, and the plate-shape member is then removed. Then, the tows are joined.

Example 1

A tow having the total degree of fineness of 180,000 dtex, width of 60 mm, and thickness of 2 mm was bonded to a corrugated board piece in the size of 300 mm×150 mm by a vinyl cloth tape (product name: Vinyl Cloth, No. 750, width: 75 mm supplied by SEKISUI CHEMICAL CO., LTD.) such that a top surface of a throw-in front end of the tow was directed upward. Then, the tow was wound in approximately 5 m around a corrugated board piece such that the tow was not twisted and housed in a plastic bag. The tow wound around the corrugated board piece was kept outside of a packaging container, and the tow started to be thrown into the packaging container. After the throw-in operation was completed, a back end of the tow was bonded to a corrugated board piece with a surface thereof on the same side as the front end was housed in the plastic bag. Then, plastic bags in which the front and back end of the tow were housed were housed in the packaging container. The packaging container was a corrugated board container having the size of 720 mm in longitudinal dimension, 720 mm in lateral dimension, and 1,000 mm in height dimension whose interior was finished with a square-bottomed interior material made of polyethylene having the thickness of 0.05 mm.

The packaging container was transferred to the carbon fiber manufacturing process. The front and back ends of the tow were respectively unwound from the corrugated board pieces and set in a flame proofing device with tape-attached surfaces thereof being directed upward. Then, the tow was removed from the corrugated board pieces, and the tow ends in the length of 700 mm from the ends of the tow were flame-proofed in the atmosphere of 250° C. at the wind velocity of 3 m/min for 120 minutes.

The flame-proofed front and back ends of the tow were bonded again to the corrugated board pieces with their same-side surfaces being directed upward and then wound around the corrugated board pieces. The tow-wound corrugated board pieces were housed in plastic bags and then housed in the packaging container.

The packaging container in which the flame-proofed front and back ends of the tow are housed was transferred to a predefined position of the carbon fiber manufacturing process. The back end of the tow was removed from the plate-shape member formed from the corrugated board piece, while the front end of the tow was left wound around the plate-shape member formed from the corrugated board piece, and the tow was then taken out of the packaging container. Then, manufacturing of a carbon fiber started with the back end of the tow. The front and back end of the tow in a next packaging container subjected to the piecing work were similarly flame-proofed, and the next packaging container was transferred to a position adjacent to the preceding packaging container. The front end of the tow in the preceding packaging container and the back end of the tow in the next packaging container were put together facing each other such that the tape-attached surfaces were directed upward and joined with each other by air interlacing at five positions spaced at intervals of 50 mm under the air pressure of 500 kPa.

Because the same-side surfaces of the tows were joined with each other, there was no twist in the obtained tow, enabling a stable and continuous operation without such a trouble as thread breakage during the flame proofing.

Example 2

An operation similar to that of the Example 1 was performed except that used tows had the total degree of fineness of 201,000 dtex, width dimension of 100 mm, and thickness dimension of 2 mm. The tows were joined on the same-side surfaces thereof. Therefore, there was no twist in the obtained tow, which led to a stable and continuous operation without such a trouble as thread breakage during the flame proofing.

Example 3

An operation similar to that of the Example 1 was performed except that used tows had the total degree of fineness of 127,000 dtex, width dimension of 50 mm, and thickness dimension of 2 mm in which two small tows including 50,000 filaments and having the monofilament degree of fineness of 1.27 dtex were combined. The tows were joined on the same-side surfaces thereof. Therefore, there was no twist in the obtained tow, which led to a stable and continuous operation without such a trouble as thread breakage during the flame proofing.

Example 4

A tow similar to that of the Example 1 was located with a throw-in front end of the tow being directed upward, and the upward surface was colored in red. The tow was wound in approximately 5 m around a commercially available cardboard tube (length: 33 cm, inner diameter: 51 mm, thickness: 1.5 mm) in untwisted state and put in a plastic bag. The tow wound around the cardboard tube was held outside of a packaging container, and the tow started to be thrown into the packaging container. After the feed of the tow ended, a surface of a back end of the tow on the same side as the front end was directed upward and colored in red, and then bonded to a cardboard tube and put in a plastic bag. The plastic bags in which the front end and the back end of the tow were housed was placed in the packaging container. The packaging container was a corrugated board container having the size of 720 mm in longitudinal dimension, 720 mm in lateral dimension, and 1,000 mm in height dimension whose interior was finished with a square-bottomed interior material made of polyethylene having the thickness of 0.05 mm.

The packaging container was transferred to the carbon fiber manufacturing process. The front and back ends of the tow were respectively unwound from the cardboard tubes and set in a flame proofing device with red-colored surfaces thereof being directed upward to be flame-proofed in the atmosphere of 250° C. at the wind velocity of 3 m/min for 120 minutes.

The flame-proofed front and back ends of the tow were wound again around the cardboard tubes with their surfaces colored in red being directed upward. The tow-wound cardboard tubes were housed in plastic bags and then placed in the packaging container.

The packaging container in which the flame-proofed front and back ends of the tow are housed was transferred to a predefined position of the carbon fiber manufacturing process. The back end of the tow was removed from the plate-shape member formed from the cardboard tube, while the front end of the tow was left wound around the plate-shape member formed from the cardboard tube, and the tow was then taken out of the packaging container. Then, manufacturing of a carbon fiber started with the back end of the tow. The front and back ends of the tow in a next packaging container subjected to the piecing work were similarly flame-proofed, and the next packaging container was transferred to a position adjacent to the preceding packaging container. The front end of the tow in the preceding packaging container and the back end of the tow in the next packaging container were put together facing each other such that the red-colored surfaces were directed upward and joined with each other by air interlacing at five positions spaced at intervals of 50 mm under the air pressure of 500 kPa.

The tows were joined on the same-side surfaces thereof. Therefore, there was no twist in the obtained tow, which led to a stable and continuous operation without such a trouble as thread breakage during the flame proofing.

Comparative Example 1

A tow was not applied with the top/bottom surface identification means, and front and back ends of the tow were not processed. Such a tow was housed in a packaging container similarly to the Example 1.

The packaging container was transferred to the carbon fiber manufacturing process. The tow was set in a flame proofing device regardless of top and bottoms surfaces on the front and back ends of the tow. Then, the ends of the tow in the length of 700 mm from the ends of the tow were flame-proofed in the atmosphere of 250° C. at the wind velocity of 3 m/min for 120 minutes.

The packaging container in which the flame-proofed front and back ends of the tow are housed was transferred to a predefined position of the carbon fiber manufacturing process. Then, manufacturing of a carbon fiber started with the back end of the tow. The front and back ends of the tow in a next packaging container subjected to the piecing work were similarly flame-proofed, and the next packaging container was transferred to a position adjacent to the preceding packaging container. The front end of the tow in the preceding packaging container and the back end of the tow in the next packaging container were put together and joined by air interlacing at five positions spaced at intervals of 50 mm under the air pressure of 500 kPa.

Because the tows were joined regardless of the top and bottom surfaces thereof, the tow was twisted unless the same-side surfaces were accidentally joined without any twist, and heat accumulation in the twisted parts during the flame-proofing process generated smoke and breakage, failing to perform a stable and continuous operation.

Comparative Example 2

A tow was not applied with the top/bottom surface identification means, and front and back ends of the tow were not processed. Such a tow was housed in a packaging container similarly to the Example 3. Because the tows were joined regardless of the top and bottom surfaces thereof, the tow was twisted unless the same-side surfaces were accidentally joined without any twist, and heat accumulation in the twisted parts during the flame-proofing process generated smoke and breakage, failing to perform a stable and continuous operation.

DESCRIPTION OF REFERENCE NUMERALS

1 carbon fiber precursor tow
1*a* front end of tow
1*b* back end of tow
2 plate-shape member (front end side of tow)
3 adhesive tape (front end side of tow)
4 packaging container
5 storage bag for tow front end
6 tow throw-in shoot (tow supply shoot)
6*a* tow feeding port (tow lead-out port)
7 plate-shape member (back end side of tow)
8 adhesive tape
9 storage bag for tow back end
10 cap (of packaging container)
11 air sucker (tow front end nipping means)
11*a* suction port
12 tow front end holding means
12*a* to 12*d* first to fourth nipping members
12*e* holding member (for tow front end)
12*e*-1, 12*e*-3 first, second horizontal shaft
12*e*-2 bent shaft
13 gear roll
14 guide roller
15 clip

The invention claimed is:

1. A packaged carbon fiber precursor tow comprising, a carbon fiber precursor tow having a flattened shape in cross section and having a first surface and a second surface opposite to the first surface is layered and packaged in a packaging container;

wherein there is no twist in a part of the carbon fiber precursor tow from a bottom part of the packaged carbon fiber precursor tow to the front end of the carbon fiber precursor tow near the top surface thereof;

a front end and a back end of the carbon fiber precursor tow are located near a top surface of the carbon fiber precursor tow which is fully layered; and top and bottom surface identification means identify the first surface and the second surface at the front end and the back end, respectively;

wherein said top and bottom surface identification means each comprise an adhesive tape fixed to a plate shaped member with said front end and said back end, respectively; and wherein said front end is wound around said top and bottom surfaces of said plate shaped member on said front end.

2. The packaged carbon fiber precursor tow of claim 1, wherein the top and bottom surface identification means to identify the first surface and the second surface include a fixing means to fix a top and bottom surface indicator to the front end and the back end of the carbon fiber precursor tow.

3. The packaged carbon fiber precursor tow of claim 1, wherein at least one end of the carbon fiber precursor tow is flame-proofed.

4. The packaged carbon fiber precursor tow of claim 1, wherein the front end and the back end of the carbon fiber precursor tow, which are packaged, are respectively housed in storage bags and placed near the top surface of the layered tow after layer stacking of the carbon fiber precursor tow in the packaging container is completed.

5. The packaged carbon fiber precursor tow of claim 2, wherein at least the front end of the carbon fiber precursor tow is wound in a length of 2 to 10 m around the top and bottom surface of said plate shaped member.

* * * * *